US009469990B2

(12) United States Patent
Dirkson

(10) Patent No.: US 9,469,990 B2
(45) Date of Patent: Oct. 18, 2016

(54) RESTRUCTURED SLAB

(71) Applicant: Restructured Surfaces, LLC, Mission Viejo, CA (US)

(72) Inventor: Danyelle Dirkson, Mission Viejo, CA (US)

(73) Assignee: Restructured Surfaces, LLC, Mission Viejo, CA (US)

( * ) Notice: Subject to any disclaimer, the term of this patent is extended or adjusted under 35 U.S.C. 154(b) by 0 days.

(21) Appl. No.: 14/214,758

(22) Filed: Mar. 15, 2014

(65) Prior Publication Data

US 2014/0272250 A1 Sep. 18, 2014

Related U.S. Application Data

(60) Provisional application No. 61/798,752, filed on Mar. 15, 2013.

(51) Int. Cl.

| | |
|---|---|
| ***E04C 2/04*** | (2006.01) |
| ***B28D 1/00*** | (2006.01) |
| ***B27G 1/00*** | (2006.01) |
| *E04C 2/00* | (2006.01) |
| *E04F 15/08* | (2006.01) |

(52) U.S. Cl.
CPC . *E04C 2/04* (2013.01); *B27G 1/00* (2013.01); *B28D 1/00* (2013.01); *E04C 2002/005* (2013.01); *E04F 15/08* (2013.01); *Y10T 428/20* (2015.01)

(58) Field of Classification Search
CPC . E04C 2/04; E04C 2002/005; Y10T 428/20; E04F 15/08; B27G 1/00
USPC ..... 428/63
See application file for complete search history.

(56) References Cited

U.S. PATENT DOCUMENTS 4,334,798 A * 6/1982 Milne ..... 404/75
2005/0191141 A1* 9/2005 Nomoto et al. ..... 409/232

* cited by examiner

*Primary Examiner* — Brent O'Hern
(74) *Attorney, Agent, or Firm* — Workman Nydegger

(57) ABSTRACT

A restructured, recycled or repurposed slab such as stone, wood or the like which includes a primary component and a secondary component which fills a fissure, crack or break in the slab. The secondary component being configured to restore the structural integrity and/or providing a continuous surface. The secondary component configured to provide a noticeable contrast in appearance to the primary component.

21 Claims, 13 Drawing Sheets

RESTRUCTURED SLAB

CROSS-REFERENCE TO RELATED APPLICATIONS

The present invention claims the benefit of priority to U.S. Provisional Patent Application No. 61/798,752, entitled "Restructured Slab," filed on Mar. 15, 2013, the entire content of which is incorporated herein by reference.

BACKGROUND OF THE INVENTION

1. Technical Field

The present invention relates to a restructured slab. In more particular, the present invention relates to a slab such as stone, wood or the like which includes a primary component and a secondary component which fills a fissure, crack or break in the slab. The secondary component restoring the structural integrity and/or providing a continuous surface and the secondary component configured to provide a noticeable contrast in appearance to the primary component.

2. Background and Relevant Art

In recent years, natural stone has been increasingly utilized in homes, corporate/business buildings and other architectural projects. Modern advancements in manufacture have increased the availability of these products to a wider demographic than was previously possible. Other slab products are also often utilized in these projects. Reclaimed and slab wood, metals and other materials products are also often incorporated into similar projects.

One of the drawbacks of stone slabs, manufactured solid surface countertops, heavy wood planks and other such materials is that fissures, grooves, scratches, cracks and even breaks can occur in the material. A number of different techniques and systems have been developed to repair, fill, or resurface the perceived anomalies. The object of such repairs is to hide, cover-up or otherwise reduce the appearance that the anomalies ever existed. For example, a similar colored or textured filler may be utilized to fill a crack so that the end user does not notice that such anomaly ever occurred. Alternatively, the cost or value of such repaired item may be discounted, wholesaled or otherwise sold for less than full retail value due to the perceived imperfections.

In some cases, the material may be trashed, used for scrap or otherwise discarded due to the perceived deficiencies or loss in value from the anomaly. Alternatively, the countertop, slab, flooring, table or other element incorporating the repaired item may be replaced, clearanced or "sent to the bone yard" due to the perceived failure. The material may even be ground down to be utilized as a substrate for a manufactured product. Considering that natural stone, authentic or reclaimed wood, or other products are a scarce material that can be costly to obtain and even more costly to manufacture, the perceived diminution in value can result in unnecessary waste. Even where a use for the product is found, marginalization of desired applications can lead to under-utilization of expensive, rare or hard to find items.

BRIEF SUMMARY OF THE INVENTION

The present invention is directed to a slab in which a fissure void, such as a break in the slab is filled with a filler element. The filler element being configured to secure a first lateral portion and a second lateral portion so as to restore the structural integrity and/or the continuity of the upper working surface of the slab. The filler element being designed to have material properties to emphasize that the filler element is comprised of a different material than the slab material. For example, the filler element may have a second fill component such as color, beads, glitter to emphasize and provide an overall look and feel of the slab which is different in nature than the original slab being repaired. In another embodiment, the filler element itself may be comprised of a material having a high contrast to the slab such as the utilization of a metallic filler element with a stone slab.

The slab material can be a broken slab of stone, such as a granite counter top. Alternatively, the slab material may comprise an antique or reclaimed wood slab having a large crack or other surface anomaly. According to one embodiment of the present invention, the filler element is utilized to repair an unintentionally cracked or broken solid surface material. According to another embodiment of the present invention, the previously broken slab may be intentionally sought out to provide a different design arrangement than a regular solid surface material. According to another embodiment of the present invention, the slab may be intentionally cut, cracked or otherwise altered to provide first, second and possibly one or a plurality of additional elements allowing the introduction of different material properties to emphasize design elements not contained in the original slab.

In one exemplary embodiment, multiple slab materials are combined using a filler element to create a combined element having a first portion which is comprised of a first material and second component comprising a second material. For example, a first element may comprise a reclaimed teak slab of wood, a second element may comprise a piece of granite, the filler element may comprise an epoxy filler with glass beads integrated therein. According to another embodiment of the present invention, a first portion may comprise one variety of natural stone and a second portion may comprise a different type of lateral stone. In yet another embodiment, a natural stone piece which is broken from a larger slab may be surrounded with a composite or glass material emphasizing the contrast between the natural stone and the other elements of the slab.

DETAILED DESCRIPTION OF THE PREFERRED EMBODIMENTS

Figure 1:
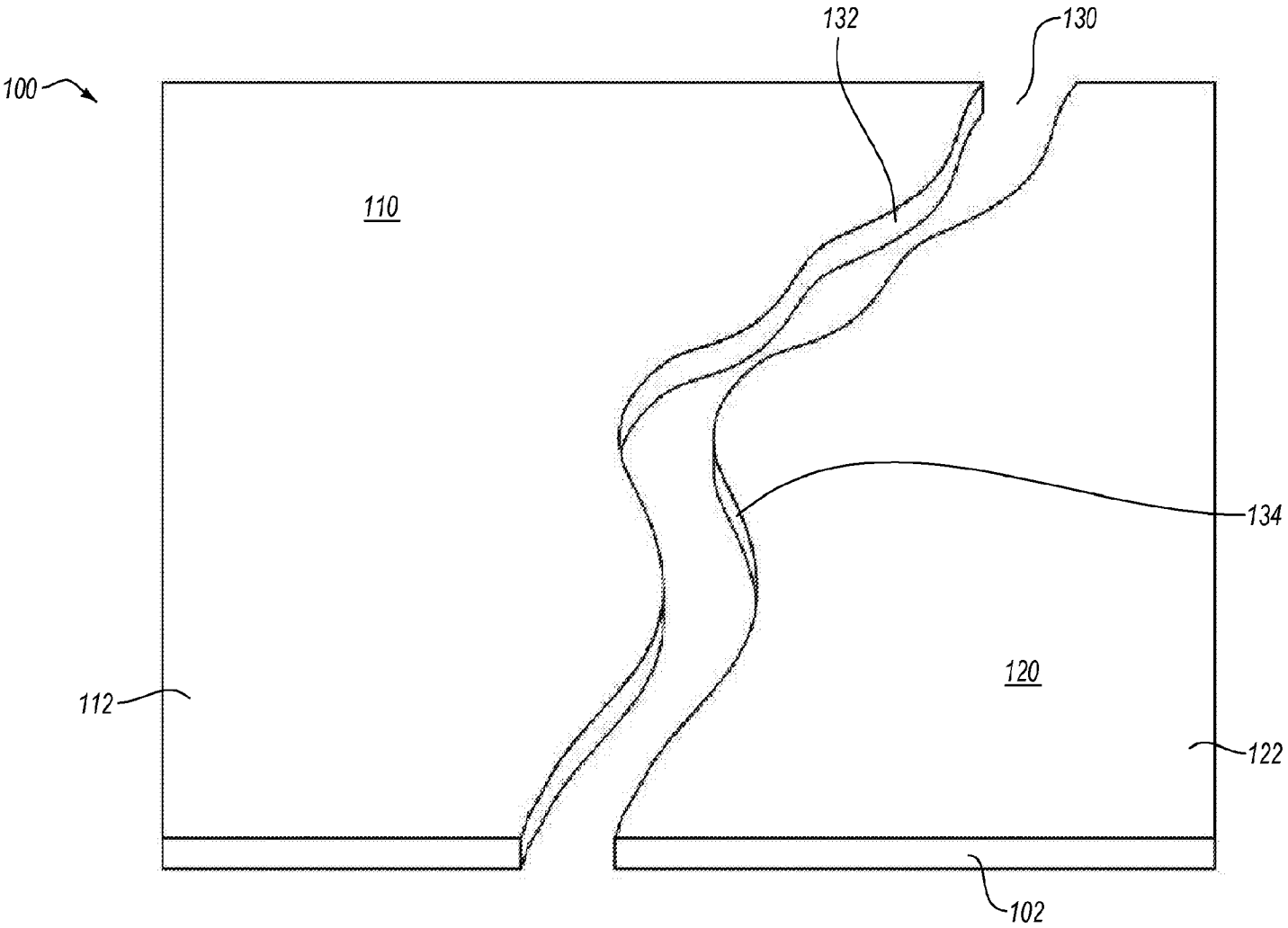
FIG. 1 is a perspective view of a slab of material having a crack, break or other void according to one aspect of the present invention.

FIG. 1 is a perspective view of a slab 100 according to one aspect of the present invention. In the illustrated embodiment, slab 100 is comprised of a solid surface material such as stone, wood, a manufactured product or other material. Slab 100 has an outer periphery 102 which defines the size and shape of the slab material. Slab 100 includes a First lateral portion 110 and a second lateral portion 120. First lateral portion includes an upper surface 112 and second lateral portion 120 includes an upper surface 122.

A fissure void 130 is positioned between first lateral portion 110 and second lateral portion 120. In the illustrated embodiment, fissure void 130 is a result of a crack or break. In the illustrated embodiment, fissure void 130 is jagged and winds angularly through slab 100. While the manner is which fissure void 130 was formed is not suggested, the crack or break could be the result of inherent weakness within slab 100. Alternatively, the crack or break could result from being dropped or impacted during manufacture, finishing, installation, transportation or through user error. Alternatively, the crack or break could occur intentionally to open the door to incorporating additional elements therein.

Fissure void 130 includes a first sidewall 132 and a second sidewall 134. First sidewall 132 corresponds with first lateral portion 110. Second sidewall 134 corresponds with second lateral portion 120. The distance between first sidewall 132 and second sidewall 134 defines a cross-sectional dimension of fissure void 130. The length of fissure void 130 is defined by the position of fissure void 130 along slab 100, including the angle, extent to which fissure void 130 is straight, winding or otherwise extends along slab 100. In the illustrated embodiment, fissure void 130 creates a complete separation between first lateral portion 110 and second lateral portion 120. It will be appreciated by those skilled in the art that a fissure void may extend through only a portion of slab 100. Additionally, the fissure void may not extend through the entire thickness of the slab. The fissure void may comprise a crack or groove. According to one embodiment, the fissure void may change along the length of the slab. For example, the fissure void may begin as a crack somewhere in the middle of the slab and extend to a periphery of the slab where a clear break extending through the entire thickness of the slab is present. Alternatively, the fissure void may be a missing portion of the slab. One portion of fissure void may be natural while another portion of the fissure void is cut, etched or otherwise man-made.

Slab 100 is one example of a first component which forming the body of the slab or other slab, plank, manufactured surface or related material. First lateral portion 110 is one example of a first portion of the first component. Second lateral portion is one example of a second portion of the first component. Fissure void 130 is one example of a void or fissure component. Fissure component can comprise a crack, break, slot, groove or other discontinuity within the first component. According to one embodiment of the present invention, the fissure component creates an identifiable degree of separation between the first portion and the second portion.

Figure 2:
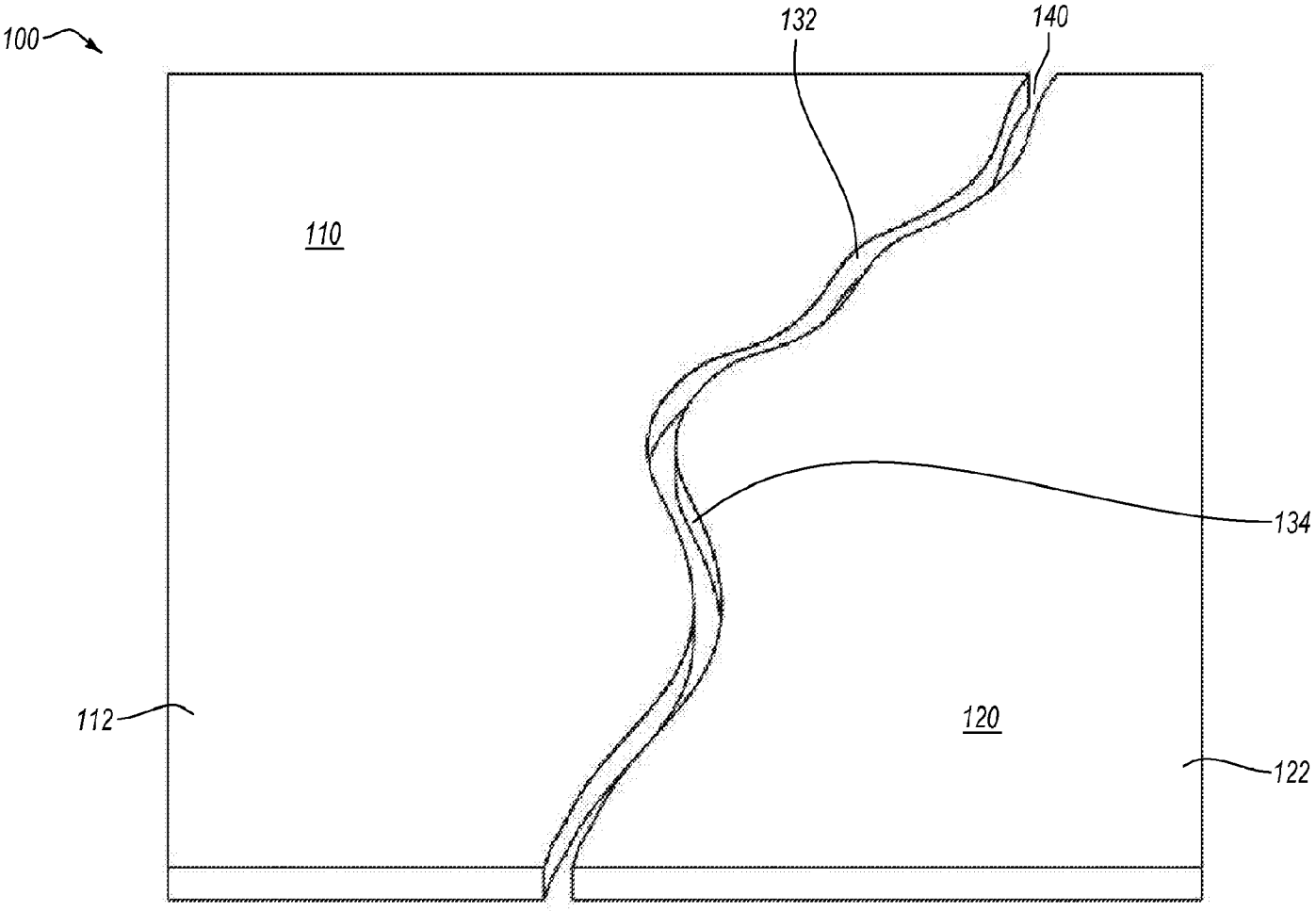
FIG. 2 is a perspective view of a slab of material in which a filler element has been utilized in connection with the void of FIG. 1 according to one aspect of the present invention.

FIG. 2 is a perspective view of a 100 slab of material in which a filler element 140 has been utilized in connection with fissure void 130 according to one aspect of the present invention. In the illustrated embodiment, filler element 140 fills the entire cross-sectional area of fissure void 130. As a result, filler element 140 extends from first sidewall 132 to second sidewall 134. As a result, slab appears to have a substantially continuous and unbroken configuration, such that upper surface 112 of first lateral portion 110 and upper surface 122 of second lateral portion 120 is coextensive with an upper surface of filler element 140. Additionally, filler element 140 can be configured to provide structural integrity to slab 110. For example, according to one embodiment of the present invention, filler element 140 is comprised of a material which binds to first sidewall 132 and second sidewall 134 so as to secure first lateral portion 110 relative to second lateral portion 120.

Filler element 140 is designed to have a different composition, color, design, reflectivity or otherwise draw a contrast to the composition of first lateral portion 110 and second lateral portion 120. In this manner, filler element 140 provides a secondary component to slab 100 than first lateral portion 110 and second lateral portion 120. In this manner, the presence of a fissure void 130 such as a break, crack, groove, cut, scratch is utilized as an opportunity to create a different type of slab, instead of a failure which diminishes the ability to utilize, install or otherwise take advantage of the slab.

In the illustrated embodiment, the cross-sectional dimensions of filler element 140 are determined based on the separation of first lateral portion 110 and second lateral portion 120 and from the thickness of slab 100. During manufacture of slab, filler element is injected, pressed, flowed or otherwise introduced into fissure void 130 between first lateral portion 110 and second lateral portion 120. According to one embodiment of the present invention, the filler element does not extend along the entire length of the fissure void. According to another embodiment of the present invention, the filler element does not completely extend through the entire thickness of the slab component. According to another embodiment of the present invention a board, brace or other support is provided underneath the slab to add strength to the portion of the slab coextensive with the fissure void.

Figure 3:
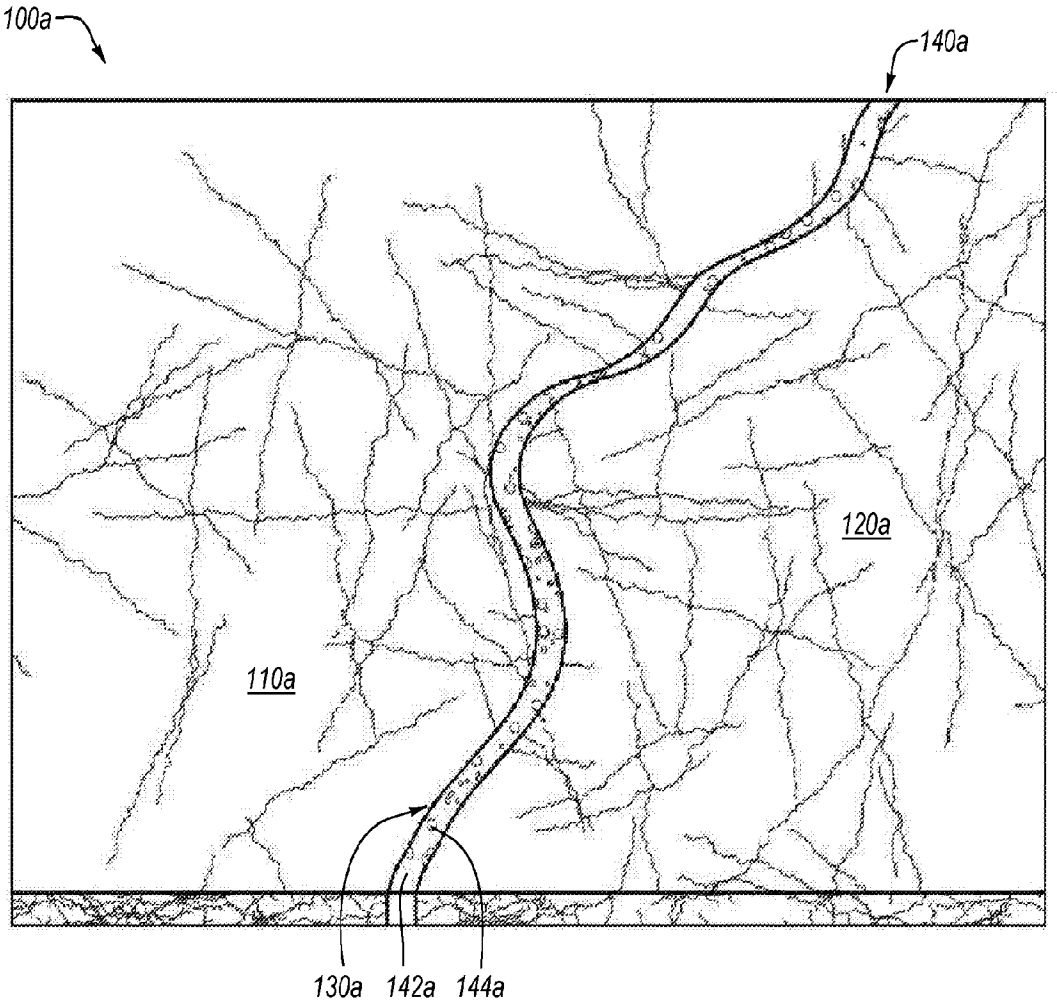
FIG. 3 is a cross-sectional view of a slab of material in which a filler element has been utilized in connection with a void according to one aspect of the present invention.

FIG. 3 is a cross-sectional view of a slab 100*a* in which a filler element 140*a* has been utilized in connection with fissure void 130*a* according to one aspect of the present invention. In the illustrated embodiment, filler element 140*a* includes a fill component 142*a* and a contrast component 144*a*. Fill component 142*a* comprises a substantially clear or translucent material that allows contrast component 144*a* to be readily identifiable or seen within filler element 140*a*. In the illustrated embodiment, fill component 142*a* comprises a plastic, epoxy, resin or other composite which is designed to secure a first lateral portion 110*a* of slab 100 to second lateral portion 120*a* of slab 100*a*. Fill component 140*a* is designed to securely fasten to first sidewall 132*a* and second sidewall 134*a*. Fill component 142*a* provides the overall length and cross-sectional dimensions of component 142*a*.

In the illustrated embodiment contrast component 144*a* is contained within fill component 142*a*. Contrast component 144*a* is depicted as a plurality of colored beads comprised of glass, plastic, ceramic, metal, wood or other material. Contrast component 144*a* provides an element that further highlights the presence of filler element 140*a* while emphasizing that is separate and different than first lateral portion 140*a* and second lateral portion 120*a*. As a result, instead of attempting to mask the presence of a fissure void 130, filler element instead emphasizes the presence, shape, form, length and design of the fissure void.

As will be appreciated by those skilled in the art, a variety of types and configuration of filler elements and filler voids can be utilized without departing from the scope and spirit of the present invention. For example, according to one embodiment of the present invention, filler element is comprised of glass. According to another embodiment of the present invention the filler element is comprised of epoxy, plastic, resin, glue, composite or other material. According to one embodiment of the present invention, the contrast component is an integrated component of the filler element. For example, a color may be added to the filler element which provides additional contrast between the filler element and other portions of the slab. According to another embodiment of the present invention, the contrast element is a completely separate feature such as a bead, glitter, ribbon, feather, leaf or other design component.

Figure 4A:
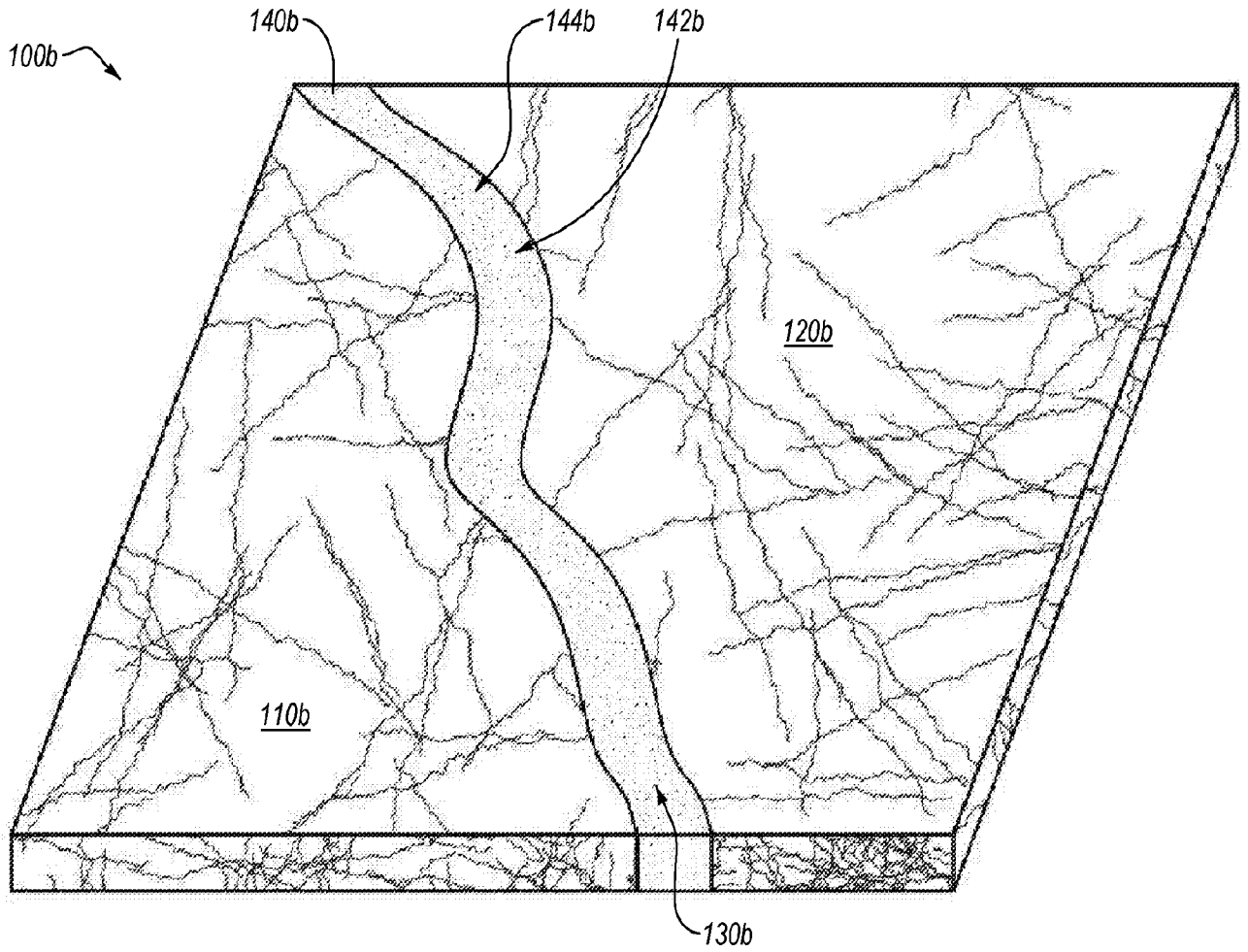
FIGS. 4A, 4B, 4C and 4D is a perspective view of a slab of material in which a filler element has been utilized in connection with a fissure void and in which a second fill component is utilized in connection with the filler element to emphasize the contrast between the filler element and the slab of material according to one aspect of the present invention.

FIG. 4A is a perspective view of a slab 100*b* in which a filler element 140*b* has been utilized in connection with the fissure void 130*b*. In the illustrated embodiment, slab 100*b* comprises a first lateral portion 110*b* and a second lateral portion 120*b* in which the first lateral portion 110*b* is comprised of the same material as second lateral portion 120*b*. For example, first lateral portion 110*b* is comprised of a marble slab and second lateral portion 120*b* is also comprised of the marble slab. In the instance in which the first lateral portion 110*b* and second lateral portion 120*b* are formed from a cracked or broken piece of the same material, any veins in the marble would be present from the portion of first lateral portion 110*b* adjacent to fissure void 130 to extent of second lateral portion 120*b* positioned on the other side of fissure void 130. This creates a unique and unitary design.

In the illustrated embodiment, filler element 140*b* is design to highlight the separation between first lateral portion 110*b* and second lateral portion 120*b*. For example, filler element 140*b* includes a fill component 142*b* and a contrast component 144*b*. In the illustrated embodiment contrast component 144*b* comprises colored glitter. Additionally a second contrast component such as a color added to filler element can be included. For example, fill component can comprise a substantially clear glass to which a purple color has been added. The contrast component can comprise a silver or gold glitter. In the embodiment, first lateral portion and second lateral portion comprise a white marble slab with grey veins. The ability to emphasize the difference between the filler element and the rest of the slab provides and opportunity for creativity, functionality and design opportunity which far surpass the use of an original or repaired unitary slab.

Figure 4B:
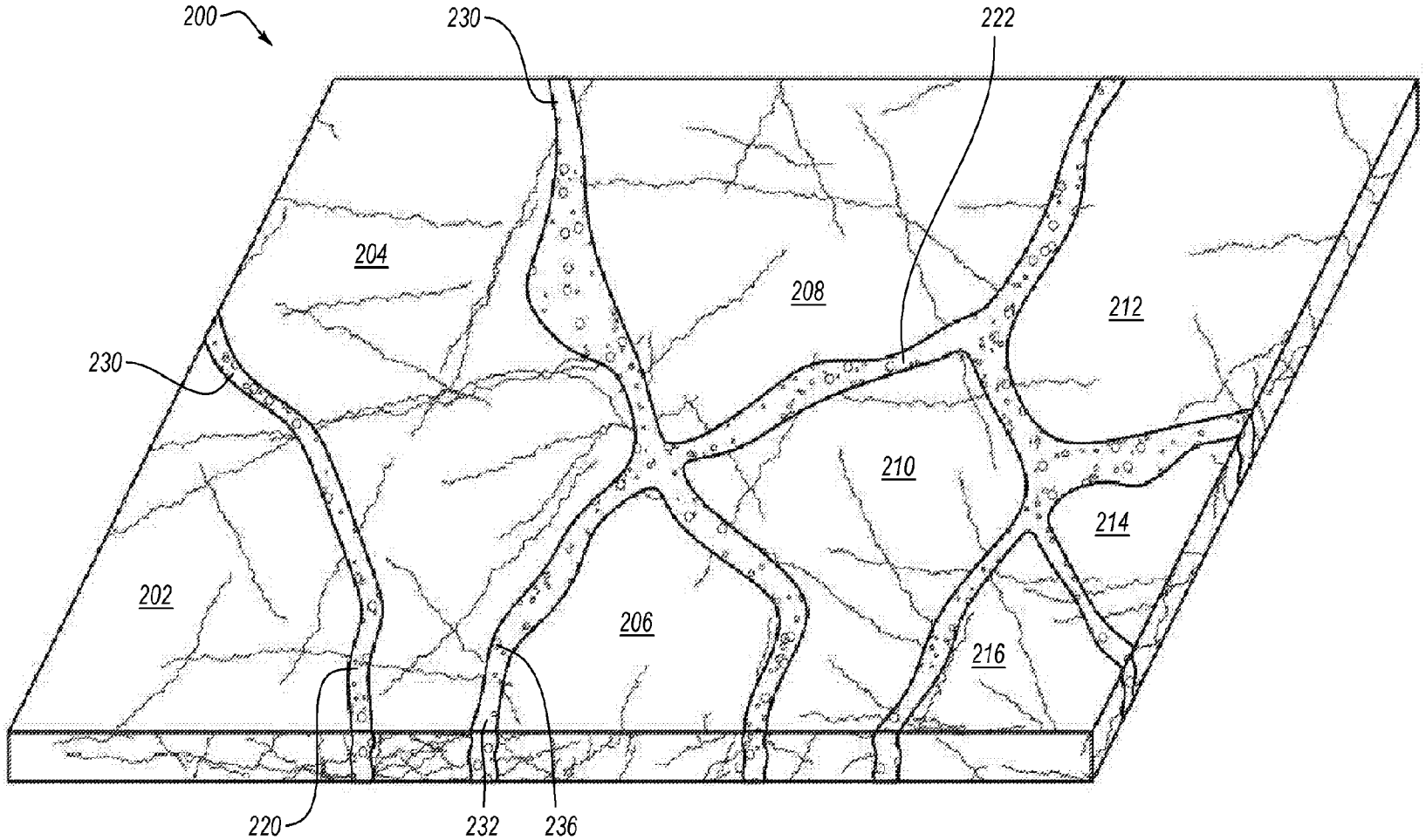

FIG. 4B is a perspective view of a multi-part slab 200 according to one aspect of the present invention. In the illustrated embodiment, slab elements 202, 204, 206, 208, 210, 212, 214 and 216 comprise the majority of the slab elements. Slab elements 202-216 are arranged in substantially the same configuration as they were arranged before the slab was broken into slab elements 202-216. In this manner, the overall look of multi-part slab 200 is that of an original, but broken slab of solid surface material. In this manner, the end user can appreciate the overall look, dimension and feel of the original slab.

In the illustrated embodiment, multi-part slab 200 includes a plurality of fissures. For example, multi-part slab 200 includes a first fissure 220 and a multi-part fissure 222. First fissure 220 and multi-part fissure are filled with filler element 230. Filler element 230 comprises a fill component 232 and a contrast component 236. Filler element 230 has been utilized in connection with the fissure voids of first fissure 220 and multi-part fissure 222. Contrast component 236 is utilized in connection with the filler element 232 to emphasize the contrast between the filler element 230 and the slab of material from which multi-part slab 200 is derived.

As will be appreciated by those skilled in the art, a variety of types and configurations of multi-part slabs can be provided without departing from the scope and spirit of the present invention. For example, the slab elements of multi-part slab can be substantially varied in size as a result of the breaking of an original slab into several different size and shaped pieces. In another embodiment, the slab elements may be equally sized stripes or squares of an original slab. In another embodiment, the slab elements may be circles cut from an original slab where the filler element comprises a substantial portion of the slab between the original slab. In another embodiment, the slab elements are selected from two or more different slabs. For example, some slab elements may be from black granite and the other slab elements are from white marble. Alternatively, slab elements can be from wood, stone, leather or other materials.

Figure 4C:
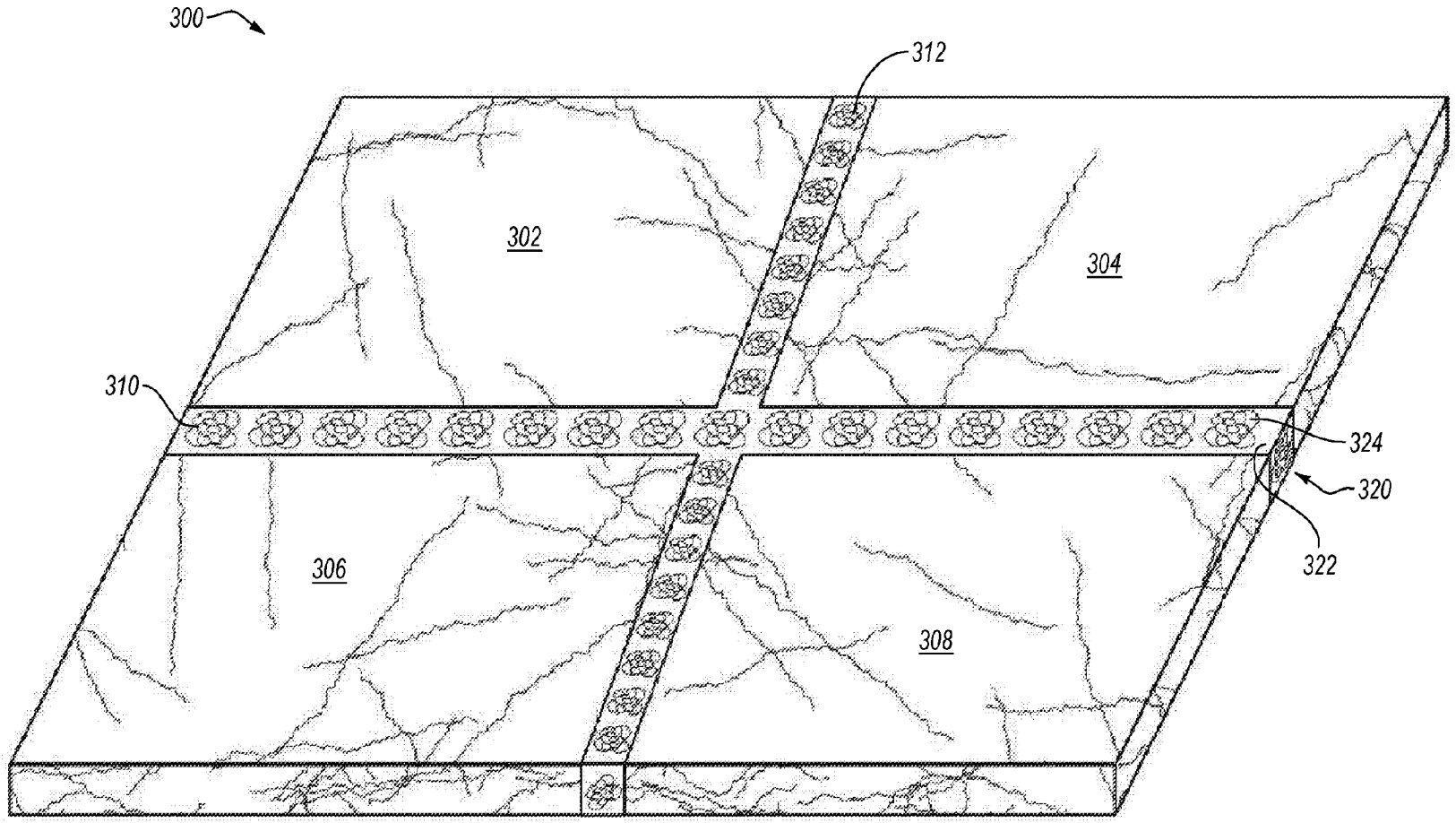

FIG. 4C is a perspective view of a structured solid surface component 300 comprised of first lateral portion 302, second lateral portion 304, third lateral portion 306 and fourth lateral portion 308. In the illustrated embodiment, lateral portions 302-308 comprise squares of the same slab material. A first cross void element 310 is intersected by a second cross void element 312. In the illustrated embodiment first cross void element 310 and second cross void element 312 are substantially straight and linear in nature. First cross void element 310 intersects second cross void element 312 perpendicularly at a right angle. First cross void element 310 and second cross void element 312 having a substantially uniform width such that lateral portions 302-308 are arranged in a square.

A filler element 320 has been utilized in connection with first cross void element 310 and second cross void element 312. Filler element 320 comprises 320 comprises a fill component 322 and contrast component 324. In the illustrated embodiment contrast component comprises plastic or dried flowers to emphasize the filler element relative to lateral portions.

A variety of types and configurations of structured solid surface components can be utilized without departing from the scope and spirit of the present invention. For example, a structured solid surface can have a plurality of component pieces sized, spaced and selected to provide a desired size, shape and pattern desired according to one aspect of the present invention. The size, shape and positioning of the void elements can be selected to further accentuate the contrast between the component pieces and the filler elements. For example, a plurality of horizontal voids that are cut can be intersected by wavy linear voids arranged vertically to intersect the horizontal voids. In another embodiment, the voids are arranged at various angles that may or may not intersect.

Figure 4D:
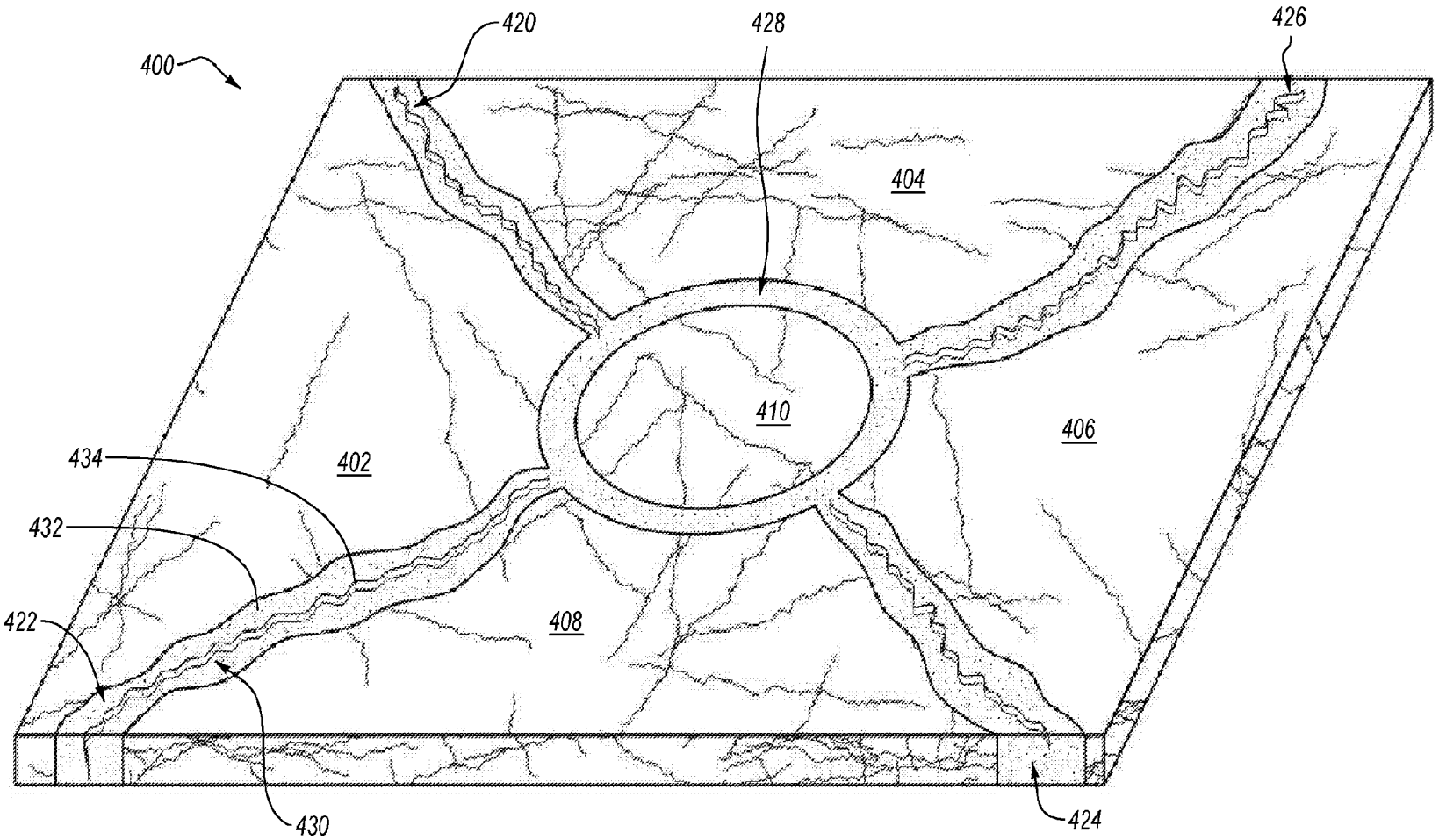

FIG. 4D is a perspective view of a structured sold surface component 400 according to one embodiment of the present invention. In the illustrated embodiment, structured solid surface component 400 comprises first lateral portion 402, second lateral portion 404, third lateral portion 406 and fourth lateral portion 408. A center slab portion 410 is also depicted. Center slab portion 410 is substantially circular in nature and is designed to fit into circumferential portions of lateral portions 402-408.

A first void element 420 is positioned between lateral portion 402 and lateral portion 404. A second void element 422 is positioned between lateral portion 402 and lateral portion 408. A third void element 424 is positioned between lateral portion 408 and lateral portion 406. A fourth void element 426 is positioned between lateral portion 404 and lateral portion 406. A circular void element 428 is also depicted. Circular void element 428 is positioned between center slab portion 410 and lateral portions 402-408. In this manner a nexus is provided between an intentionally and uniformly cut portion of structured solid surface 400 and intentional breaks formed between lateral portions 402-408.

In the illustrated embodiment a filler element 430 has been utilized in connection with the void elements 420-428. Filler element incorporates a fill component 432 comprising a leather strap to emphasize the contrast between the filler element 430 and the other components of structured solid surface component 400 according to one aspect of the present invention. FIG. 4D depicts a contrast component 434.

Figure 5:
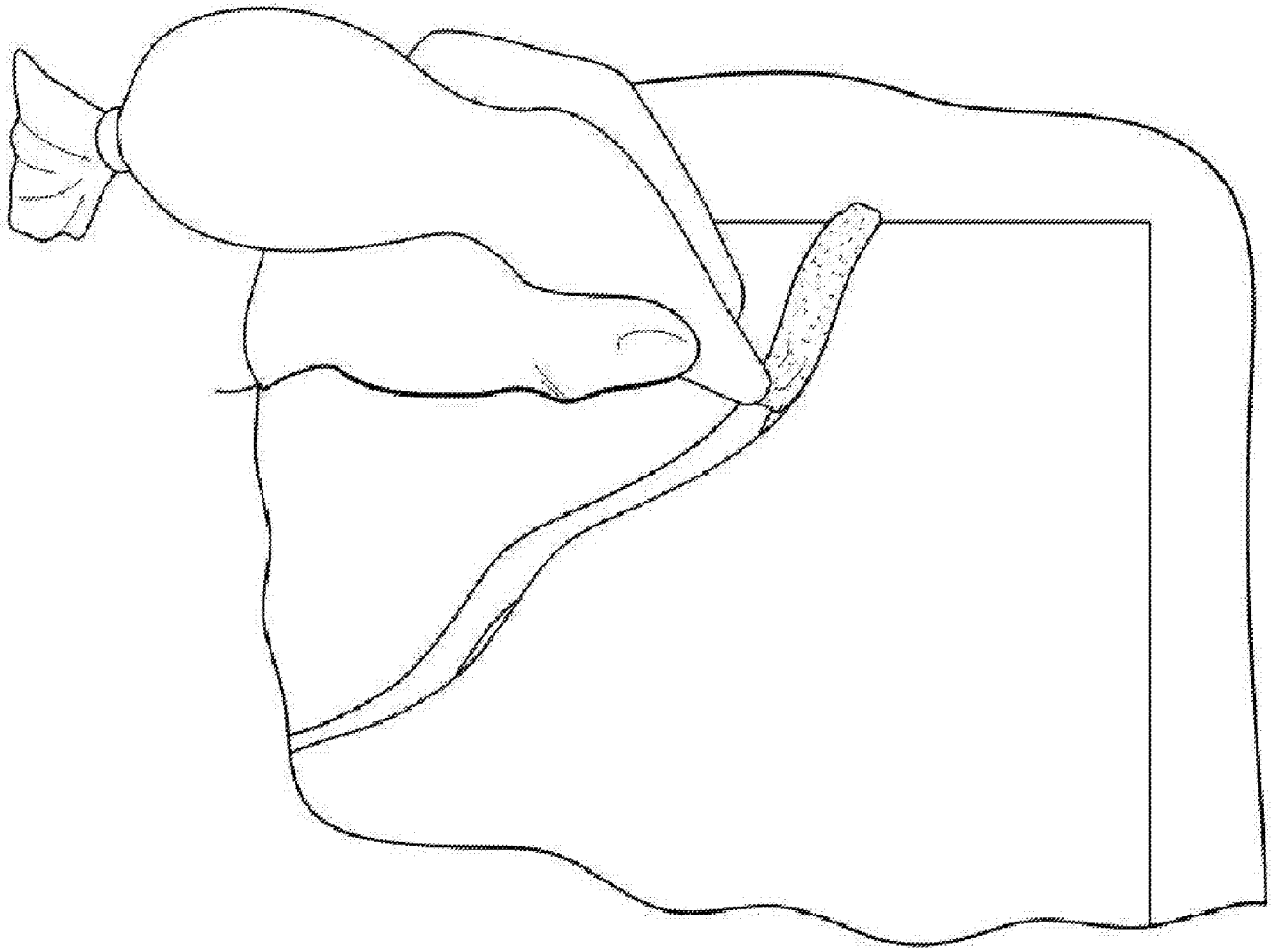
FIG. 5 is a perspective view of a slab of material in multiple breaks in the slab create a plurality of fissure voids and in which a filler element has been utilized in connection with the plurality of fissure voids according to one aspect of the present invention.
Figure 6:
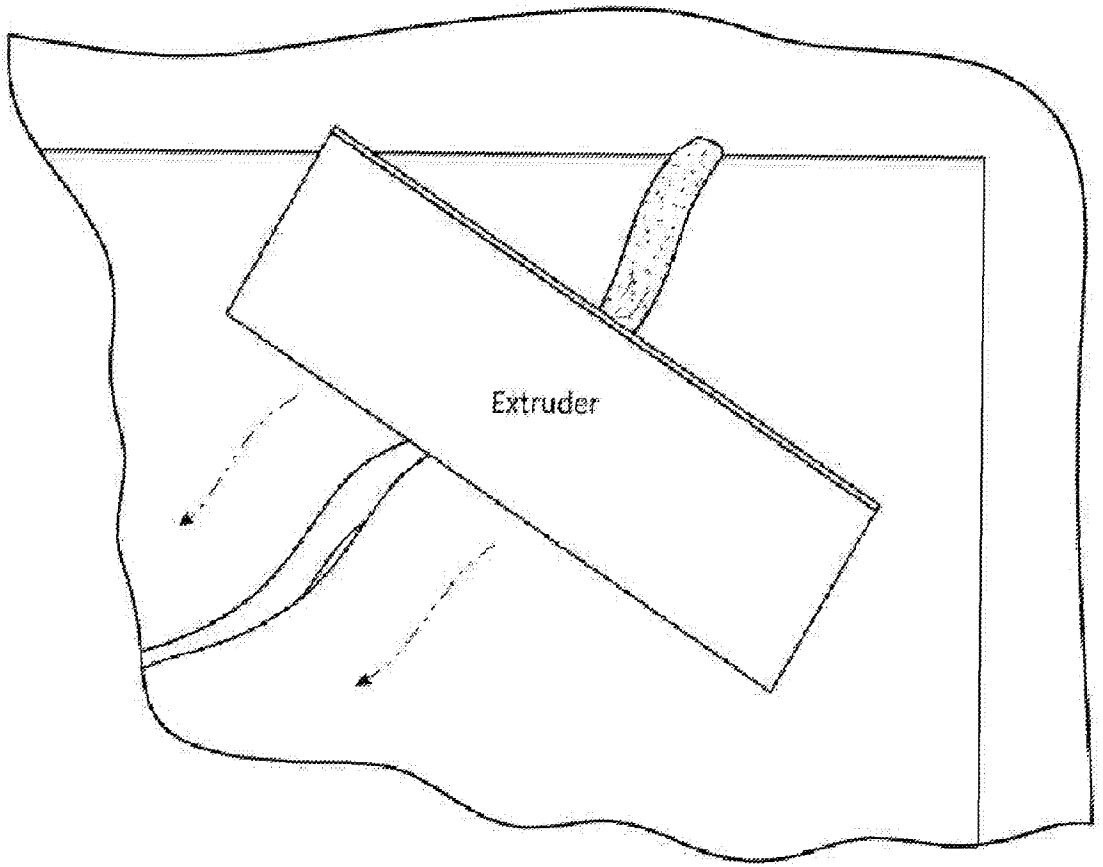
FIG. 6 is a perspective view of a slab of material in which a plurality of fissure voids are formed by cuts in the slab and in which a filler element has been utilized in connection with the plurality of fissure voids according to one aspect of the present invention.

FIGS. 5 and 6 depict the addition of a filler medium into a void in the slab material. According to one embodiment of the present invention, a filler is flowed into a crack, break, groove, slot or other discontinuity within the slab. A backing may be provided to ensure the retention and proper filling of the discontinuity or other void. According to another embodiment of the present invention, the filler material is injected or extruded into the fissure void. A variety of types and configurations of filler materials can be utilized. For example, a resin, acrylic, epoxy, glass, polymer or other material can be utilized. According to another embodiment of the present invention a recycled material can be utilized for one or both of the filler material and the contrast material. A variety of types and configurations of filling the discontinuity can be utilized by those skilled in the art without departing from the scope and spirit of the present invention.

Figure 7:
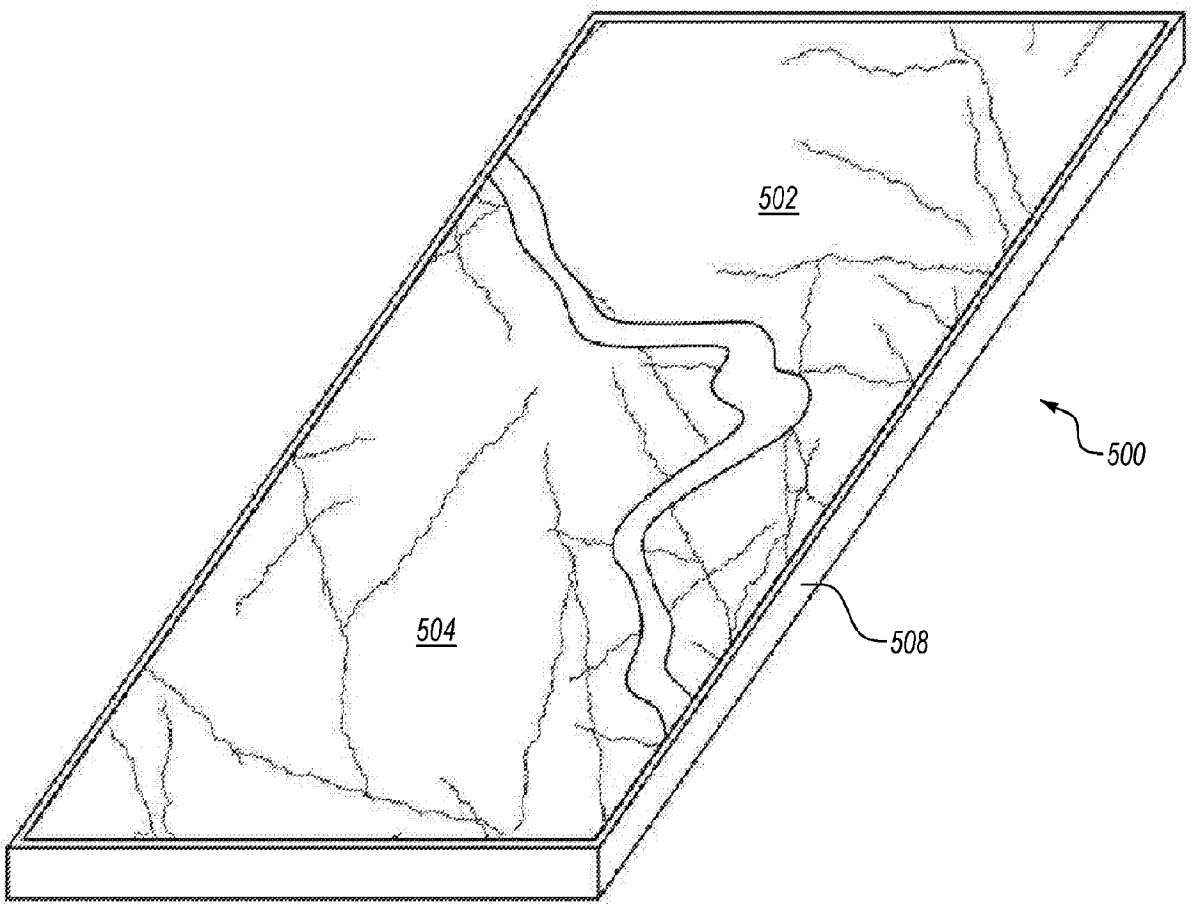
FIG. 7 is a perspective view of a slab of material in which a metal filler element has been utilized in connection with the fissure void and in metal layer circumscribes the slab according to one aspect of the present invention.

FIG. 7 is a perspective view of a slab of material in which a metal filler element has been utilized in connection with the fissure void and in metal layer circumscribes the slab according to one aspect of the present invention. In the illustrated embodiment a stone slab 500 is illustrated. Stone slab 500 provides the bulk of the body of the slab. Stone slab 500 comprises a first slab component 502 and a second slab component 504. In the illustrated embodiment a metal fill element 506 is utilized to fill the discontinuity in the slab that separates first slab component 502 and second slab component 504. A metal boundary 508 is also provided. Metal boundary 508 circumscribes the outer periphery of stone slab 500. Metal boundary may be comprised as the same material as metal fill element 506. Alternatively, metal fill element 506 may be comprised of a secondary metal material to provide an additional level of layering or appearance. Metal boundary may provide additional structural integrity according to one aspect of the present invention.

Figure 8:
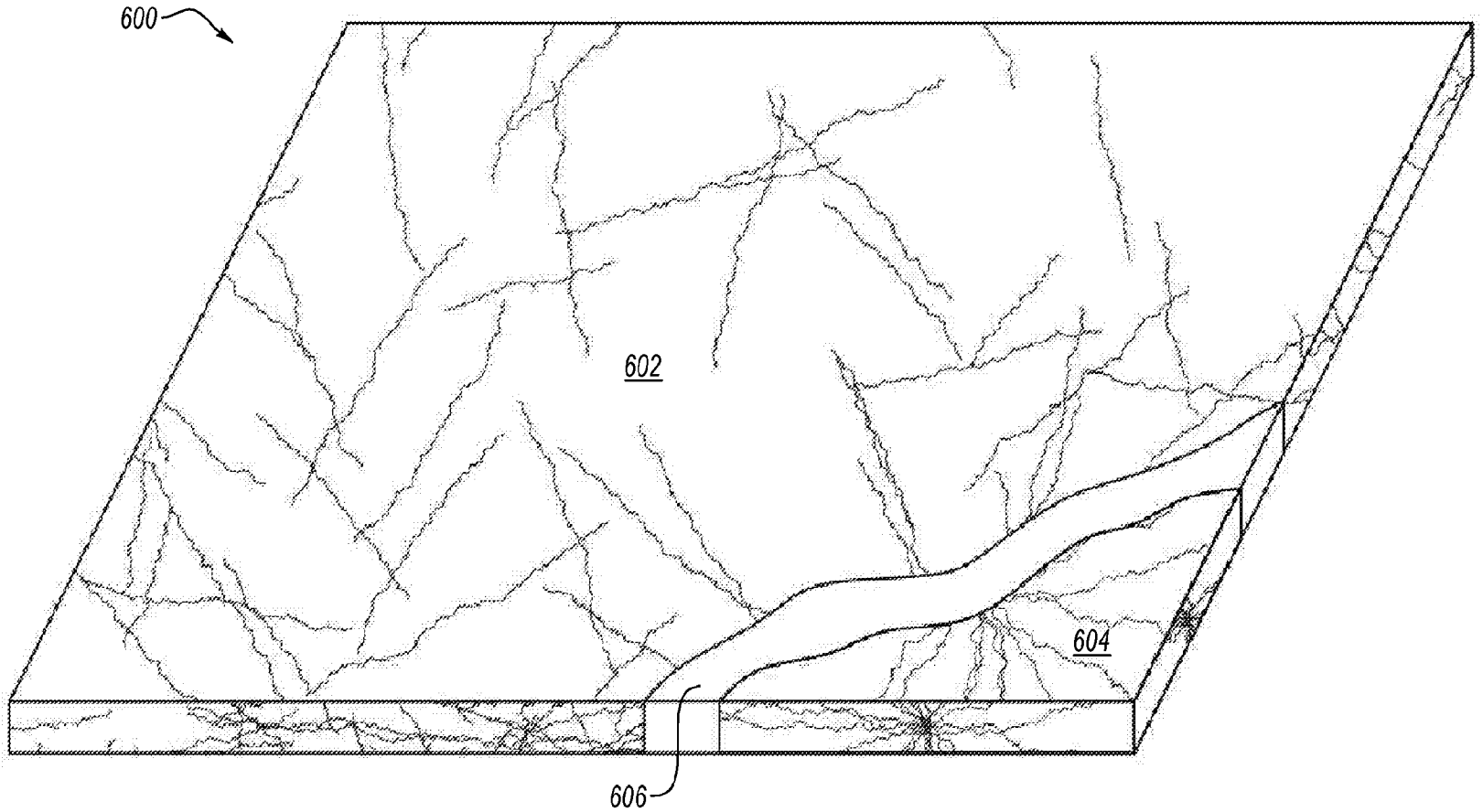
FIG. 8 is a perspective view of a slab of material in which the first lateral portion comprises a first type of stone such as granite and the second lateral portion comprises a second type of stone such as a second type of granite and the fill component is designed to provide a contrast between the first lateral portion and the second lateral portion according to one aspect of the present invention.

FIG. 8 is a perspective view of a slab of material in which the first lateral portion comprises a first type of stone such as granite and the second lateral portion comprises a second type of stone such as a second type of granite and the fill component is designed to provide a contrast between the first lateral portion and the second lateral portion according to one aspect of the present invention. In the illustrated embodiment, a composite stone slab 600 is depicted. Composite stone slab includes a first granite component 602 and a second granite component 604. First granite component may be of a different color, grain, texture or may otherwise be formed of a different stone material than second granite component.

Additionally a ground granite filler 606 is depicted. Ground granite filler 606 fills the discontinuity within slab 600. Ground granite filler 606 may be designed to provide additional contrast between first granite component 602 and second granite component 604. Alternatively, ground granite filler 606 may be designed to complement or even match one or both of first granite component and second granite component 604.

Figure 9:
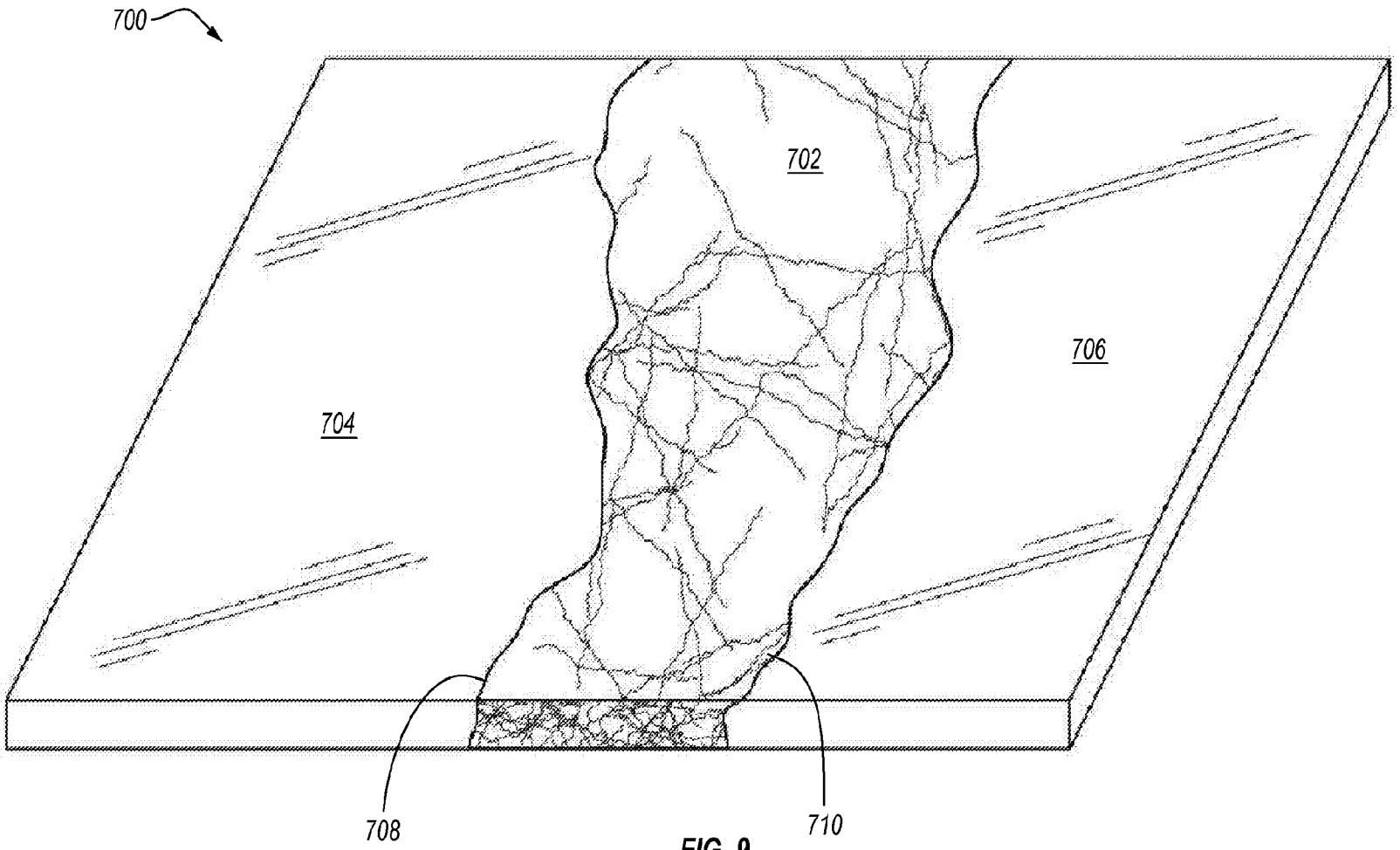
FIG. 9 is a perspective view of a slab of material in which a first lateral portion comprises a solid manufactured surface, a second lateral portion comprises a natural stone component and a third lateral portion comprises a solid surface manufactured surface which is same material as the first lateral portion according to one aspect of the present invention.
Figure 10:
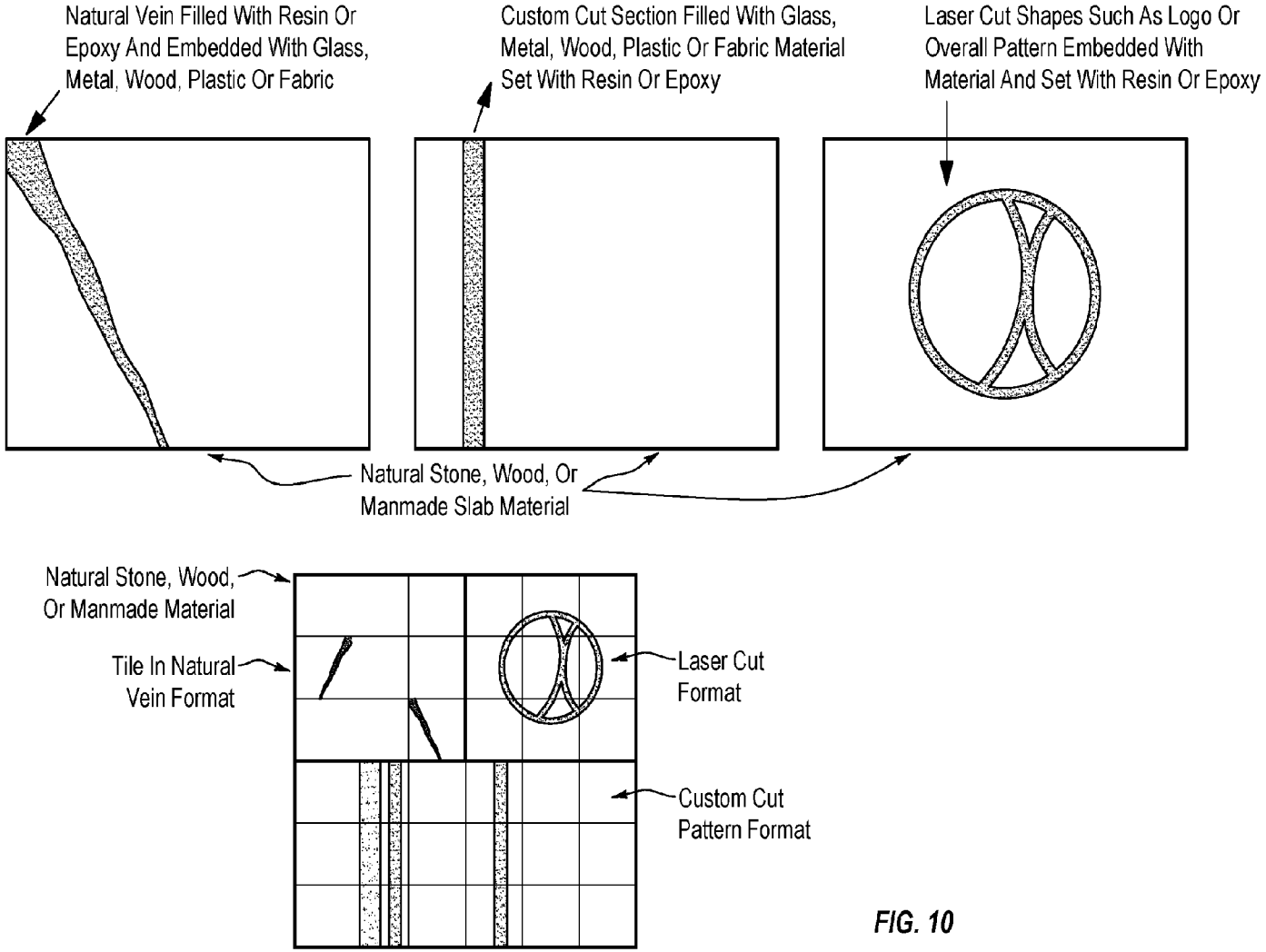
FIG. 10 is a depiction of another implementation of the present invention.

FIG. 9 is a perspective view of a slab of material in which a first lateral portion comprises a solid manufactured surface, a second lateral portion comprises a natural stone component and a third lateral portion comprises a solid surface manufactured surface which is same material as the first lateral portion according to one aspect of the present invention. In the illustrated embodiment, a multi-part slab 700 is depicted. Multi-part slab 700 includes a first quartz slab component 702, a colored glass component 704 and a colored glass component 706. By utilizing a quartz slab component 702, which may be a broken piece from a larger original stone slab, a piece of stone material which was likely to be discarded may be recycled, reclaimed or otherwise repurposed.

Quartz slab component 702 is bordered by colored glass component 704 and colored glass component 706. In this manner, a full slab can be utilized within an architectural, building or other design application. Furthermore, the color, texture and other material properties of quartz slab component are accentuated by the differing material properties, color, transparency of colored glass components 704 and 706. Thus a broken piece of stone, rather than being discarded becomes an opportunity to create something useful, functional and having a improved appearance to regular stone. Additionally, FIG. 9 depicts a first interface 708 and a second interface 710.

As will be appreciated by those skilled in the art, the specific compositions, designs, textures, looks and feels of the slab materials depicted in FIGS. 1-9 are illustrative in purpose. FIGS. 1-9 are not intended to limit the scope or extent of possible alternatives of restructured slabs within the scope of the present invention. A variety of slab materials, filler materials, enhancement features can be utilized without departing from the scope and spirit of the present invention. For example, the slab may comprise a cracked or broken piece of glass, stone, wood, manufactured material or other material which is conducive for a secondary filler material. According to another embodiment of the present invention, the filler material is designed to provide primarily a different look and feel of the slab and is not structural in nature. According to another embodiment of the present invention, the restructured slab does not have a substantially continuous surface, but instead is designed to have differing material properties.

LIST OF REFERENCE NUMBERS

100 Slab (first component)
102 Outer periphery
110 First lateral portion (first portion)
112 Upper Surface
120 Second lateral portion (second portion)
122 Upper Surface
130 Fissure Void
132 first sidewall
134 second sidewall
140 filler element
142 fill component
144 contrast component
200 multi-part slab
202-216 slab elements
220 first fissure
222 multi-part fissure
230 filler element
232 fill component
236 fill component
236 contrast component
300 structured solid surface component
302-308 first-4th lateral portions
310 first cross void element
312 second cross void element
320 a filler element
322 fill component
324 contrast components
300 structured solid surface component
302-308 first-4th lateral portions
310 a first cross void element
312 an intersecting void element
320 a filler element
322 fill component
324 contrast components
400 structured solid surface component
402-408 first-4th lateral portions
410 center slab portion
420-426 void elements
428 circular void element
430 filler element
432 fill component
434 contrast components
500 stone slab
502 first slab component
504 second slab component
506 metal fill element
508 metal boundary
600 composite stone slab
602 first granite component
604 second granite component
606 ground granite filler
700 multi material slab
702 quartz slab component
704 colored glass component
706 colored glass component
708 first interface
710 second interface

I claim:

1. A restructured slab comprising:

a first component forming the body of the slab and having a first portion and a second portion;

a fissure component which comprises a crack, break, slot, groove or other discontinuing within the slab, the fissure component creating an identifiable degree of separation between the first portion and the second portion; and a second component configured to fill the fissure component and restore structural integrity of the slab component such that the first portion and the second portion and second component comprise a complete slab having a substantially continuous configuration, where the second component comprises:

a fill component that comprises a substantially clear or translucent material; and a contrast component integrated within the fill component such that the contrast component is visible within the fill component.

2. The restructured slab of claim 1, wherein the slab component comprises a slab of continuous stone.

3. The restructured slab of claim 2, wherein the slab component comprises a granite slab.

4. The restructured slab of claim 2, wherein the slab component comprises a limestone slab.

5. The restructured slab of claim 2, wherein the slab component comprises a marble slab.

6. The restructured slab of claim 1, wherein the contrast component comprises color beads.

7. The restructured slab of claim 6, wherein the beads comprise a material selected from a group consisting of glass, plastic, ceramic, metal, and wood.

8. The restructured slab of claim 1, wherein the contrast component comprises a feature selected from a group consisting of a ribbon, a feather, a leaf, a flower, or a leather strap.

9. The restructured slab of claim 1, wherein the fissure component comprises multiple breaks in the slab separating the first portion from the second portion and wherein one or more additional components are also created from the slab.

10. A restructured slab comprising;

a first component forming the body of the slab and having a first portion and a second portion;

a fissure component creating an identifiable degree of separation between the first portion and the second portion; and a second component configured to fill the fissure component and restore structural integrity of the slab component such that the first portion and the second portion and second component comprise a complete slab have a substantially continuous configuration, where the second component comprises:

a fill component that comprises a substantially clear or translucent material; and a contrast component integrated within the fill component such that the contrast component is visible within the fill component, wherein the contrast component comprises colored beads.

11. The restructured slab of claim 10, wherein the fissure component comprises a groove creating a degree of discontinuity within the slab.

12. The restructured slab of claim 10, wherein the fissure component comprises a crack creating a discontinuity within at least the surface of the slab.

13. The restructured slab of claim 10, wherein the fissure component comprises a break creating a discontinuity within the slab.

14. The restructured slab of claim 10, wherein the fissure component comprises a slot creating a discontinuity within a portion of the slab.

15. A restructured slab comprising;

a first component forming the body of the slab and having a first portion and at least a second portion;

a discontinuity within the slab, the discontinuity creating an identifiable area such that the first portion is identifiable relative to the at least second portion; and a second component configured to fill the discontinuity within the slab and restore structural integrity of the slab component such that the first portion and the second portion and second component comprise a complete slab have a substantially continuous configuration, where the second component comprises:

a fill component that comprises a substantially clear or translucent material; and a contrast component integrated within the fill component such that the contrast component is visible within the fill component, wherein the contrast component comprises a leather strap.

16. The restructured slab of claim 15, wherein the discontinuity within the slab is formed from a natural break or crack within the slab.

17. The restructured slab of claim 15, wherein the discontinuity within the slab is formed by cutting or laser etching within the slab.

18. The restructured slab of claim 15, wherein the discontinuity within the slab comprises a single crack, break, cut or groove.

19. The restructured slab of claim 18, wherein the discontinuity within the slab comprises a plurality of cracks, breaks, cuts or grooves.

20. The restructured slab of claim 18, wherein the discontinuity within the slab comprises a combination of one or more natural breaks or cuts within the slab and one or more cuts or laser etchings within the slab.

21. A recycled and repurposed slab of building material comprising;

a first component forming at least 50% of a body of a slab, the first component comprised of natural stone, wood or other material that has been broken, cracked or otherwise altered, but continues to have the appearance and be identifiable as an original slab before such break, crack or discontinuity was formed in the slab;

a discontinuity within the slab, wherein the discontinuity comprises a crack, break, slot, groove or other discontinuing within the slab, the discontinuity creating an identifiable degree of separation within portions of the first component;

a second component configured to fill the discontinuity within the slab and restore structural integrity of the slab component such that the first component and second component comprise a complete slab having a substantially continuous configuration, where the second component comprises a metal fill material; and a metal boundary that circumscribes the outer periphery of the slab, wherein the metal boundary comprises the same metal material as the metal fill material.

* * * * *